US005097889A

United States Patent [19]

Ritter

[11] Patent Number: 5,097,889

[45] Date of Patent: Mar. 24, 1992

[54] HOT SPOT DETECTION AND SUPRESSION SYSTEM

[75] Inventor: Kent E. Ritter, Wellsville, N.Y.

[73] Assignee: ABB Air Preheater, Inc., Wellsville, N.Y.

[21] Appl. No.: 639,299

[22] Filed: Jan. 11, 1991

[51] Int. Cl.[5] ..... F28D 19/04; F28G 9/00

[52] U.S. Cl. ..... 165/5; 165/7

[58] Field of Search ..... 165/5, 7

[56] References Cited

U.S. PATENT DOCUMENTS

| | | | |
|---|---|---|---|
| 1,814,040 | 7/1931 | Hoglund | 165/5 |
| 3,183,961 | 5/1965 | Brandt | 165/7 |
| 3,730,259 | 5/1973 | Wixson et al. | 165/5 |
| 4,022,270 | 5/1977 | Stockman | 165/5 |
| 4,383,572 | 5/1983 | Bellows | 165/5 |
| 4,823,861 | 4/1989 | Warrick | 165/5 |

*Primary Examiner*—Albert W. Davis, Jr.

*Attorney, Agent, or Firm*—Chilton, Alix & Van Kirk

[57] ABSTRACT

A hot spot detection system (78) at one location that is fixed with respect to the rotor (12), and a temperature suppression system (62) at another location that is fixed with respect to the rotor. The suppression system is automatically energized by the hot spot detection system when a threshold temperature is detected. Preferably, the suppression system includes one or more pipes (66) that span the radial dimension of the heating element compartments in the rotor. The detection system can be in the conventional location, on the trailing edge (40) of the air inlet duct (32) of the air preheater. The suppression piping (66) is preferably located in the hot end, or air discharge duct (34), of the air preheater. Depending on the location of the suppression piping with respect to rotor rotation, a timing device (100) is preferably employed to start and stop the flow of suppression water into the rotor, just prior to and after the hot spot passes under the piping.

22 Claims, 4 Drawing Sheets

HOT SPOT DETECTION AND SUPRESSION SYSTEM

BACKGROUND OF THE INVENTION

The present invention relates to industrial air preheaters, and more particularly, to apparatus and method for detecting and suppressing so-called "hot spots" in regenerative, rotary heat exchangers.

U.S. Pat. No. 4,383,572, issued on May 17, 1983 to K. Bellows for a Fire Detection Cleaning Arrangement, describes an infrared sensing array for the rotor of a rotary regenerative heat exchanger adapted to view the infrared ray emission from the rotor at a plurality of radially distinct zones. In the system disclosed in the '572 patent, and other systems using a variety of analogous detection techniques, the entire area of the rotor can be monitored. Conventionally, when a hot spot is sensed within the rotor, an alarm is energized requiring operator intervention in various forms. Depending on the circumstances, this can involve energizing deluge or suppression systems, opening access doors and utilizing fire hoses, or similar corrective action. Thus, conventionally, responding to the hot spot detection system alarm of the prior art, requires manual operations and can consume valuable or even critical time. It is well known in this field that hot spots can, if not cooled quickly enough, lead to combustion of trapped deposits in the matrix of the rotor. These can rapidly escalate to temperatures high enough that the metal rotor bursts into flame, potentially causing extensive damage not only to the heat exchanger, but to other equipment and components in the plant.

SUMMARY OF THE INVENTION

It is, accordingly, an object of the present invention to provide a temperature suppression capability coupled with the hot spot detection capability, by which corrective action in response to hot spot detection can be achieved automatically, without human intervention.

It is a further object of the invention that the suppression system be controlled to operate in the hot spot suppression mode for a relatively short burst having a duration significantly less than the period for a complete rotation of the rotor.

It is yet another object of the invention to minimize the amount of suppression fluid introduced into the rotor for mitigating the hot spot, by activating only a selected radial portion of the suppression system, corresponding to the radial location of the hot spot.

These and other objects and advantages of the invention are achieved in a broad aspect of the invention, by providing a hot spot detection system at one location that is fixed with respect to the rotor, and a temperature suppression system at another location that is fixed with respect to the rotor. The suppression system is automatically energized by the hot spot detection system when a threshold temperature is detected.

Preferably, the suppression system includes one or more pipes that span the radial dimension of the heating element compartments in the rotor. The detection system can be in the conventional location, on the trailing edge of the air inlet duct of the air preheater. The suppression piping is preferably located in the hot end, or air discharge duct, of the air preheater. Depending on the location of the suppression piping with respect to rotor rotation, a timing device is preferably employed to start and stop the flow of suppression water into the rotor, just prior to and after the hot spot passes under the piping. This reduces the amount of potentially damaging water introduced into the rotor.

In another improvement, to further minimize the amount of water introduced into the rotor during suppression, the suppression piping includes a plurality of substantially radially spaced spray nozzles which are individually activated in response to the radial location of the individual sensor that detected the hot spot.

Thus, in accordance with the preferred method of the present invention, a hot spot detection system identifies a hot spot and generates an excess temperature signal that automatically initiates the actuation of a suppression piping array or the like. The nozzles on the piping array selectively spray water only as needed to reduce the hot spot temperature.

It should be appreciated that the system may require several sequential cycles of detecting a given hot spot and initiating localized suppression action, until the temperature of the hot spot falls below the threshold value and the piping array is deactivated.

BRIEF DESCRIPTION OF THE DRAWINGS

These and other objects and advantages of the invention will be described below with reference to the accompanying drawings, in which.

DESCRIPTION OF THE PREFERRED EMBODIMENT

Figure 1:
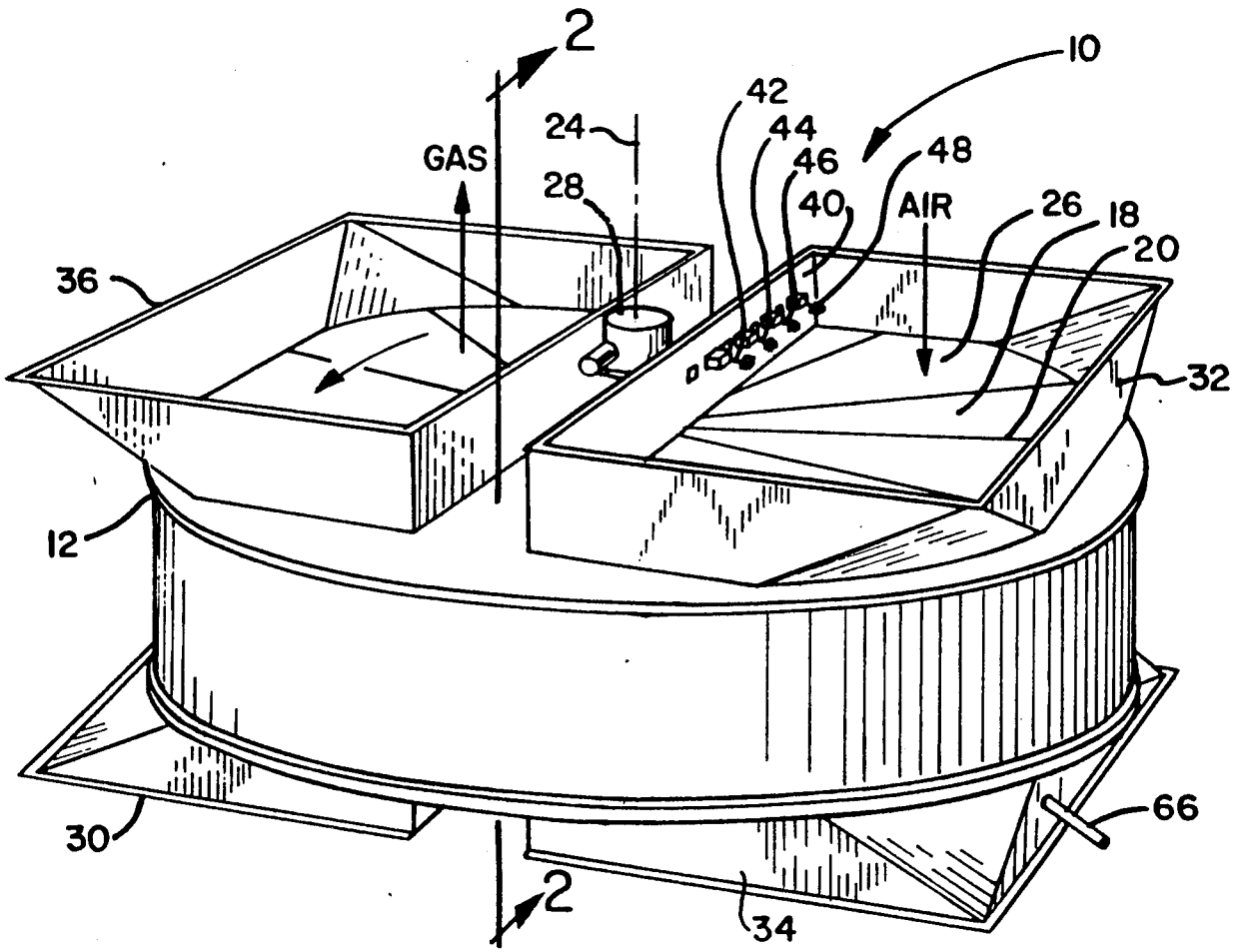
FIG. 1 is a perspective view of a rotary regenerative heat exchanger that includes the detection and suppression features of the present invention.
Figure 2:
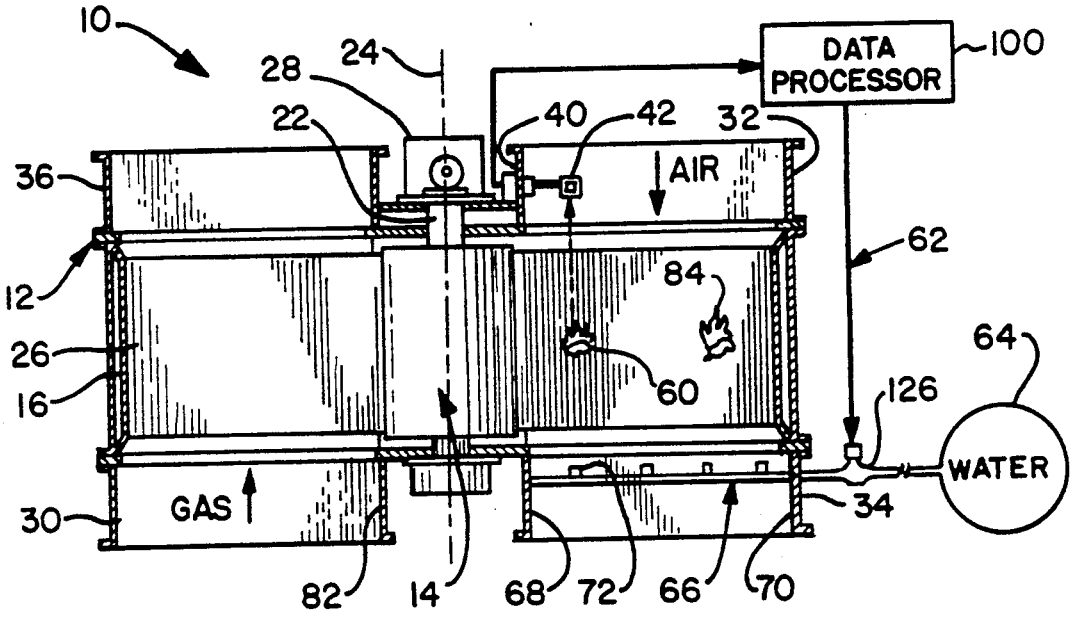
FIG. 2 is a sectional view of the heat exchanger as seen from line 2—2 of FIG. 1.

FIGS. 1 and 2 depict a rotary regenerative air preheater 10 comprising a cylindrical housing 12 that encloses a rotor 14 having a cylindrical casing 16. A series of compartments 18 are formed in the casing by radial partitions 20 extending between the casing and a central rotor post 22 defining the axis of revolution 24. The compartments each contain a matrix of heat absorbent material 26 in the form of corrugated plates or the like that provide passageways for the flow of fluid therebetween in a known manner.

The rotor revolves slowly about its axis 24 by a motor 28 to advance the heat absorbent material contained in the compartments, alternately between a heating fluid passing through the rotor in on direction, and a fluid to be heated which passes through the rotor in the opposite direction. The matrix 26 absorbs heat from the heating fluid, hereinafter referred to as the gas, which enters gas inlet duct 30, and transmits the absorbed heat to a cooler fluid, herein referred to as air, entering the heat exchanger through air inlet duct 32. After passing over the heated matrix and absorbing heat therefrom, the air is discharged through air outlet duct 34 to a boiler, furnace or other place of use, as preheated air, while the cooled gas is discharged to the environment or other heat sink through gas outlet duct 36.

As is described in U.S. Pat. No. 4,383,572, the disclosure of which is hereby incorporated by reference, instrumentation or other means are provided at any convenient location at a duct, preferably along inner wall 40 of the air inlet duct 32, for sensing "hot spots" that may develop in the rotor matrix 26 during use. Typically, such instrumentation is in the form of an array of infrared sensor heads 42, 44, 46, 48 mounted in spaced-apart relation on the wall 40 so as to substantially span the radial extent of the compartments containing the heat absorbent matrix.

Figure 3:
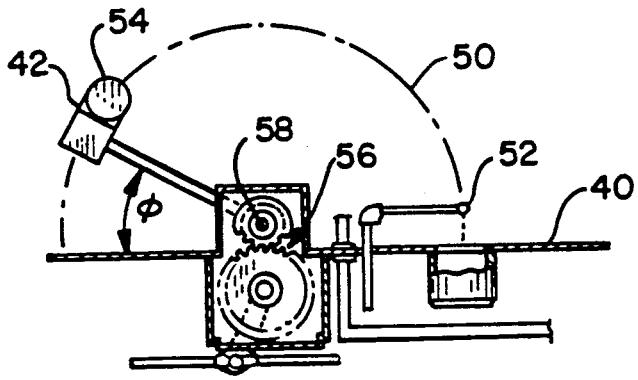
FIG. 3 is an enlarged top view of one infrared sensor head, showing the angular range of motion of each sensor in the detection array shown in FIG. 1.

In a typical implementation of the infrared detection system, each sensor head is adapted to pivot in a manner shown in FIG. 3. Thus, each sensor head such as 42 is actuable to follow an arcuate path 50 which may conveniently include a cleaning nozzle 52 at one extreme position in the arc, adapted to wash the lens 54 on the sensor head. The gearing and drive subsystem associated with the arcuate movement of each sensor head, preferably drive all heads in unison. The pivot points 58 of each scanning head are spaced apart by approximately one diameter of the pivot arc 50, whereby the arcuate scanning motion of each of a plurality of radially spaced heads can detect a hot spot over a respective plurality of annular portions of the matrix 26. The array of detectors can thus scan the entire matrix surface of the rotor.

It should be appreciated, however, that although the entire rotor matrix surface 26 is scanned, each "point" at the matrix surface is scanned for only a brief moment, once every time the rotor makes a complete revolution. Moreover, different "points" along a given radius at the surface are sensed at a different time, depending on the angular position of the particular sensor head along the arcuate path. Nevertheless, it is well within the skill of an ordinary practitioner in this art to establish a functional or tabular relationship that predicts the precise moment during each revolution of the rotor, at which a given point at the matrix surface will be sensed for a hot spot by the nearest sensor head.

In FIG. 2, the first sensor head 42 is visible, and hot spot 60 is illustrated substantially vertically below the sensor 42, midway through the vertical extent of the heat exchange matrix material 26. In accordance with the present invention, a hot spot suppression system 62, preferably including piping 66 connected to a source of water under pressure 64, is situated in any convenient location or locations at which a spray of suppression fluid can be discharged toward the heat exchange matrix 26. In FIG. 2, the piping 66 is shown as spanning the inner and outer walls 68, 70 of the hot side of the air duct 34. Preferably, the suppression piping includes a plurality of individually controllable spray nozzles such as 72, four of which are shown in FIG. 2. For example, each of the four spray nozzles may be located at a different radial distance from the rotation axis 24 of the rotor, each radial position corresponding to the average radial distance of a respective sensor head such as 42, as it follows its arcuate path as shown in FIG. 3.

Figure 4:
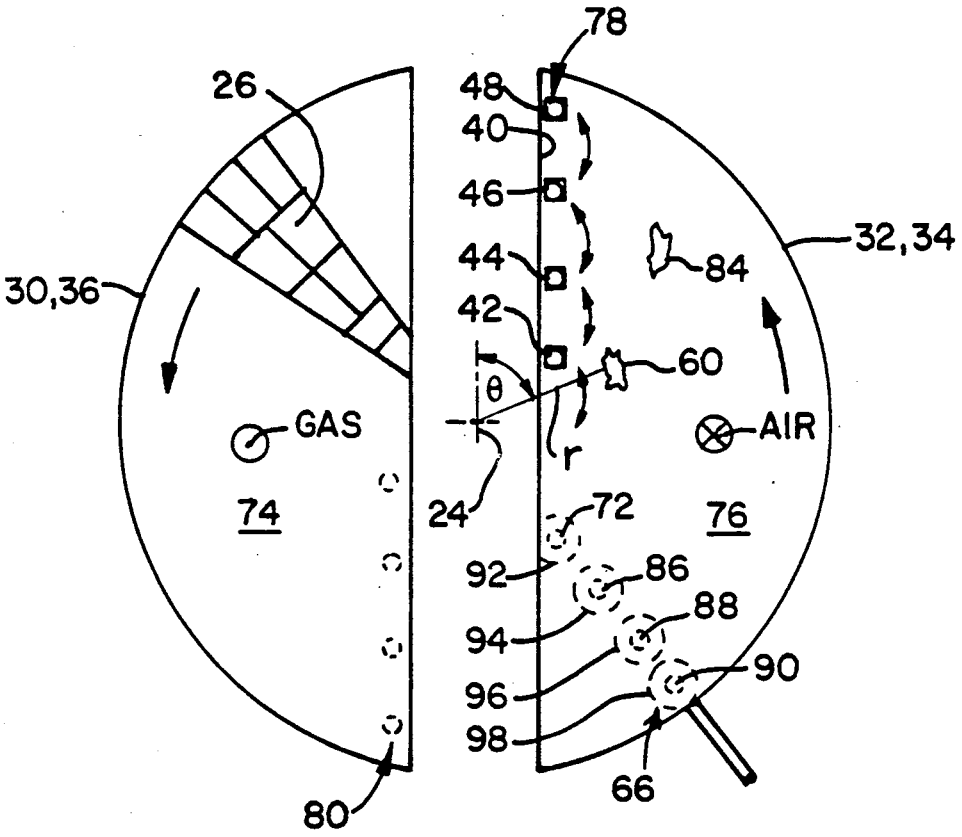
FIG. 4 is a schematic plan view of the heat exchanger of FIG. 1, with emphasis on the portions of the rotor that are accessible through the ducts.

FIG. 4 is a schematic plan view of the upper surface of the matrix as visible through the ducts. The gas side 74 and air side 76 of the rotor are depicted and the detection sensor array 78 is shown as consisting of discrete, substantially radially spaced apart sensor heads 42, 44, 46, 48 on the air side 76. Two different orientations of the suppression piping are shown, one 80 that is substantially in parallel opposition to the detection sensor array 78, and the other 66 (also shown in FIG. 2) that is substantially on a radial line passing through the revolution axis 24 of the rotor. It should be appreciated that FIG. 4 is a schematic showing the radial relationship of the sensor array 78 and suppression piping 66, 80. Preferably, the sensor heads 78 are located at wall 40 of the air inlet duct 32. The suppression piping 66 is shown in phantom because it is situated in the air outlet duct 34 as shown in FIG. 2. The piping 80 is also shown in phantom because it is located at wall 82 of the gas inlet duct 30 shown in FIG. 2.

It should be appreciated that the sensor array 78 and the suppression array 80 nozzle are not precisely aligned along a radius originating on the rotation axis 24 of the rotor. As used herein, however, the term "radially spaced apart" or the like is intended to indicate a spacing having a general directionality from the inner portion of the rotor toward the outer portion of the rotor, for example, including a true radial direction or a substantially radial direction along a wall of a duct.

FIG. 4 depicts the hot spots 60, 84 shown in FIG. 2 in a manner that more easily illustrates the relationship between the radial position of the hot spot, the detection of the individual hot spot by a particular sensor in array 78, and the ability in accordance with the invention, to suppress the hot spot by actuating only one of the plurality of suppression nozzles 72, 86, 88, 90 in the suppression nozzle array 66. Of course, under some circumstances it may be necessary for all spray nozzles to be actuated simultaneously, but in the usual circumstance of detecting one or more isolated hot spots, it is preferred that only one or two, but less than all, suppression nozzles be activated individually.

Moreover, it can be appreciated upon inspection of FIG. 4, that with a constant speed of revolution of the rotor, the particular radial and angular coordinates r, $\theta$ of each hot spot 60, 84 can be inferred as a function of time from sensing the moments during the pivotting of the sensor heads along angle $\phi$ (see FIG. 3), when the hot spot is initially detected, then passes out of detection range. This information is then used to predict when the given hot spot will have rotated from its angular position corresponding to the detection of the hot spot, to its angular location within the spray pattern of a given suppression nozzle. As shown in FIG. 4, each spray nozzle 72, 86, 88, 90 is configured to produce a respective pattern 92, 94, 96, 98, preferably conical, such that at the surface of the heat exchange matrix material 26, the circular surface areas of spray contact substantially overlap, thereby affording a substantially complete strip of radial coverage by the spray patterns if all nozzles are activated simultaneously.

The timing of the activation of each nozzle can then be determined such that the spray is started when the particular hot spot such as 60, 84 first enters the coverage zone of the particular activated nozzle, such as 92, 96. The spray is maintained for a period of time dependent on the angular widths of the hot spot and the activated spray pattern, i.e., until the hot spot passes out of the coverage zone of the nozzle spray.

In the example depicted in FIG. 4, detectors 42 and 46 would be most likely to identify hot spots 60 and 84, respectively, and nozzles 72 and 88 would most likely be individually activated to suppress the hot spots with spray pattern 92 and 96 , respectively.

Figure 5:
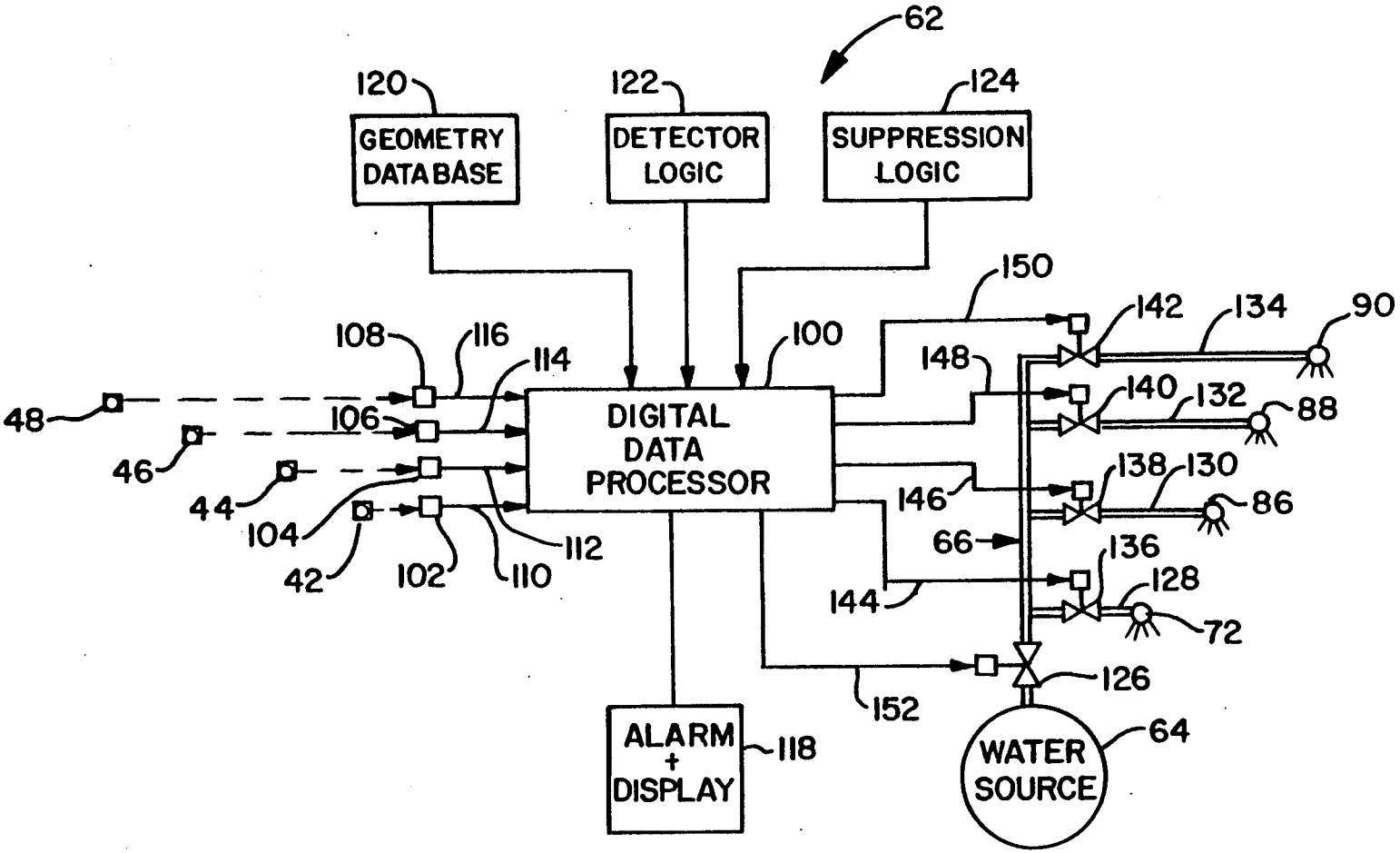
FIG. 5 is a schematic diagram of the control system associated with the present invention.

FIG. 5 depicts schematically the suppression control system 62 for implementing the preferred embodiment of the invention. The heart of the control system is a digital processor 100, such as a programmable logic controller of the type that is conventionally used with hot spot detection systems, or a computer if more sophisticated features or interfaces are desired. Regardless of the form of the processor 100, however, each of the sensor heads 42, 44, 46, 48 has an associated transducer 102, 104, 106, 108 which generates a respective signal 110, 112, 114, 116 commensurate with the temperature sensed by the sensor. The temperature signals are delivered to the processor 100, and may optionally also be delivered to an alarm/display panel 118 in the control room. The processor or computer 100 is preprogrammed, or has access to stored programs, including a geometry database 120, a detector logic program 122, and a suppression logic program 124.

The geometry database 120 contains the information discussed with respect to FIGS. 2, 3 and 4 above, such as the radius of the rotor 14, the timing of the movement of the sensor heads such as 42 along the arcuate path 50 as shown in FIG. 3, the average distance from the axis during the traversal of each head along the arcuate path 50, the effective radius of each suppression nozzle, the speed of rotation of the rotor, the coverage area or diameter of the spray patterns 92–98, and similar information.

The detector logic 122 is conventional, and would include, for example, the manner in which a threshold is set for indicating an alarm condition on the display and generating an excess temperature signal for initiating the suppressive action of the spray nozzles. The threshold temperature requiring suppressive action, may depend on a number of circumstances including the operating condition of the plant, e.g., startup, steady state, transient load following, or coast down, or the duration of time at which a given relatively high temperature persists, or other variables known to practitioners in this field. In essence, the detector logic 122 and processor 100 utilize the sensor output signals 110–116 to determine when a hot spot associated with each sensor head, requires corrective action, and to otherwise generate monitoring, cautionary, or alarm condition outputs on the display 118.

The suppression logic program 124 actuates the discharge of suppressive cooling fluid when the logic program 122 indicates the necessity for corrective action to begin. In its simplest form, the suppression logic 124 merely opens a valve 126 so that every spray nozzle 72, 86, 88, 90 begins spraying and remains activated until all alarm conditions have been mitigated. In a more sophisticated logic, all spray nozzles are activated simultaneously and deactivated simultaneously, but timed, based on the geometry database, so that the water is sprayed only while at least one hot spot is within the effective suppression coverage of the radial strip or sector defined by the spray patterns. In a further refinement, only the nozzles necessary for spraying the selected portions of the rotor in which hot spots have been detected are actuated, with the respective discharges lasting only while the respective hot spots are within the spray pattern of the respective nozzle.

One way of implementing this preferred suppression logic, is by providing, for example, four separate pipes 128, 130, 132, 134, each corresponding to one of the four sensor heads, each pipe having its own spray nozzle and associated control valve 136, 138, 140, 142 with actuator. The suppression logic 124 combined with the other information sent to the processor 100, sends an actuation signal along one or more control lines 144, 146, 148, 150 to the respective control valve actuators. Control valves permit the intensity of the spray pattern to be controlled as part of the suppression logic, but the valves could in a more straightforward implementation be solenoid valves having either an open or closed condition. Each of the valve actuation signals on lines 144, 146, 148, 150, 152 can also be delivered to the alarm display panel along with a signal from the water source 64 indicating sufficient pressure therein to provide the required delivery rate for each nozzle.

It should thus be appreciated that the present invention affords a significant improvement over the conventional hot spot detection and suppression techniques, by automatically performing the suppression function quickly, and without human intervention. Moreover, the suppression function can be implemented in accordance with the invention, with varying levels of sophistication by which the amount of water introduced into the rotor for suppression purposes can be minimized.

It should further be appreciated that, although the embodiment described above is merely exemplary in nature, the scope of the invention for which exclusive rights are desired, is defined by the appended claims.

I claim:

1. A heat exchanger comprising:

a stationary housing having hot and colt ends;

a matrix of heat exchange material supported to revolve within the housing about an axis of revolution passing through the hot and cold ends;

gas duct inlet means and gas duct outlet means fluidly connected to the housing, for introducing a flow of hot gas into the matrix at the housing hot end to raise the temperature of the matrix, and discharging the gas from the matrix at the housing cold end, respectively;

air duct inlet means and air duct outlet means fluidly connected to the housing, for introducing a flow of cold air into the matrix at the housing cold end to reduce the temperature of the matrix, discharging the air from the matrix at the housing hot end, respectively;

detection means situated at any of said duct means, for sensing, while the matrix revolves, whether any portion of the matrix has a temperature exceeding a threshold value;

suppression means situated at any of said duct means, for discharging a cooling fluid into the matrix while the matrix revolves, the suppression means including a plurality of discrete, spaced nozzles substantially spanning the radial dimension of the matrix, the suppression means being adapted to discharge the fluid from selected nozzles in an amount sufficient to reduce the temperature of the portion of the matrix which the fluid contacts; and control means coupled between the detection means and the suppression means, for activating the suppression means when the temperature of any portion of the matrix exceeds said threshold temperature and deactivating the suppression means when no portion of the matrix exceeds said threshold temperature.

2. The heat exchanger of claim 1, wherein the detection means is situated at the air duct inlet means.

3. The heat exchanger of claim 2, wherein the suppression means is situated at the air duct outlet means.

4. The heat exchanger of claim 1, wherein the housing and the matrix are substantially cylindrical and the detection means includes a plurality of discrete temperature sensors spaced apart substantially along a first radius of the housing thereby substantially spanning the radial dimension of the matrix.

5. The heat exchanger of claim 4 wherein the nozzles are spaced apart substantially along a second radius of the housing, each nozzle producing a cooling fluid spray pattern directed into the matrix.

6. The heat exchanger of claim 5, wherein the control means includes means for computing the lapse of time between the moment that a particular portion of the matrix is detected along said first radius as exceeding the threshold temperature and the moment said particular portion comes within the spray pattern of at least one nozzle along said second radius; and means for activating said at least one nozzle only while said particular portion of the matrix is within the spray pattern of said at least one nozzle.

7. The heat exchanger of claim 5, wherein the control means includes, means for associating each sensor with at least one but less than all of the nozzles, and means for activating only said at least one associated nozzle in response to the detection of an excess temperature by a given sensor.

8. The heat exchanger of claim 1, wherein, each of said duct means includes a wall that substantially spans the radius of revolution of the matrix, the detection means includes a plurality of discrete sensors supported in spaced apart relation along a first of said walls, and the suppression means are supported by a second of said walls.

9. The heat exchanger of claim 8, wherein the suppression means includes at least one pipe supported by said second wall, and a source of pressurized water in fluid communication with the pipe.

10. The heat exchanger of claim 9, wherein, said pipe has one end supported by said second wall adjacent the axis of revolution, and another end supported by another wall situated farther from said axis than said second wall.

11. A method for controlling the peak temperature in a rotary heat exchanger of the type including a stationary housing having a central axis, a matrix of heat exchange material supported to revolve within the housing about said axis, gas inlet and outlet ducts for introducing a flow of hot gas into the matrix to raise the temperature of the matrix and discharging the gas from the matrix, respectively, air inlet and outlet ducts for introducing a flow of cold air into the matrix to reduce the temperature of the matrix and discharging the air from the matrix, respectively, wherein the method comprises the steps during rotary operation, of:

sensing a matrix variable indicative of the peak temperature in the matrix and identifying the localized portion of the matrix having the peak temperature;

maintaining a source of temperature suppressant adjacent the revolving matrix, generating an excess temperature signal when the peak temperature as sensed exceeds a threshold value; and in response to the excess temperature signal, automatically discharging the temperature suppressant into the localized portion of the matrix.

12. The method of claim 11, wherein the step of discharging includes timing the discharge to begin and end only while said localized portion of the matrix is adjacent the source of temperature suppressant at said ducts.

13. The method of claim 11, wherein the source of temperature suppressant includes a plurality of spaced apart nozzles in fluid communication with a pressurized supply of suppressant liquid, and the step of discharging includes discharging suppressant liquid through at least one but less than all of said nozzles.

14. The method of claim 11, wherein the step of sensing is performed in one of the inlet and outlet ducts, and the step of discharging is performed in another of said inlet and outlet ducts.

15. The method of claim 11, wherein the step of sensing includes continuously reciprocating each of a plurality of discrete infrared sensor heads along respective arcuate paths in one of said inlet and outlet ducts, and the step of discharging includes discharging suppressant liquid through at least one of a plurality of discrete, spaced apart nozzles into the matrix through another of said inlet and outlet ducts.

16. The method of claim 15, wherein the step of sensing includes determining which discrete sensor head detected the localized excess temperature, and the step of discharging includes discharging at least one but less than all the nozzles depending on which particular sensor head detected the excess temperature.

17. A heat exchanger comprising:

a stationary housing having hot and cold ends;

a matrix of heat exchange material supported to revolve within the housing about an axis of revolution passing through the hot and cold end;

gas duct inlet means and gas duct outlet means fluidly connected to the housing, for introducing a flow of hot gas into the matrix at the housing hot end to raise the temperature of the matrix, and discharging the gas from the matrix at the housing cold end, respectively;

air duct inlet means and air duct outlet means fluidly connected to the housing, for introducing a flow of cold air into the matrix at the housing cold end to reduce the temperature of the matrix, and discharging the air from the matrix at the housing hot end, respectively;

detection means situated at any of said duct means, for sensing, while the matrix revolves, whether any portion of the matrix has a temperature exceeding a threshold value;

suppression means situated at any of said duct means, for discharging a cooling fluid into the matrix in a spray pattern while the matrix revolves; and control means coupled between the detection means and the suppression means, for activating the suppression means when the temperature of any portion of the matrix exceeds said threshold temperature and deactivating the suppression means when no portion of the matrix exceeds said threshold temperature, the control means including means for computing the lapse of time between the moment that a particular portion of the matrix is detected as exceeding the threshold temperature and the moment said particular portion comes within the range of the spray pattern.

18. The heat exchanger of claim 17, wherein the detection means includes a plurality of discrete, spaced temperature sensors substantially spanning the radial dimension of the matrix.

19. The heat exchanger of claim 18, wherein the suppression means includes a plurality of discrete, spaced nozzles substantially spanning the radial dimension of the matrix, each nozzle having a individual spray pattern, and the control means includes means for activating only the nozzles having individual spray patterns within the range of the portion of the matrix detected as exceeding the threshold temperature.

20. The heat exchanger of claim 19, wherein the control means includes, means for associating each sensor with at least one but less than all of the nozzles, and means for activating only said at least one associated nozzle in response to the detection of an excess temperature by a given sensor.

21. The exchanger of claim 17, wherein, each of said duct means includes a wall that substantially spans the radius of revolution of the matrix, the detection means includes a plurality of discrete sensors supported in spaced apart relation along a first of said walls, and the suppression means are supported by a second of said walls.

22. The head exchanger of claim 21, wherein the suppression means includes at least one pipe supported by said second wall, and a source of pressurized water in fluid communication with the pipe.

* * * * *